US007012385B1

(12) United States Patent
Kulish et al.

(10) Patent No.: US 7,012,385 B1
(45) Date of Patent: Mar. 14, 2006

(54) MULTI-CHANNEL INDUCTION ACCELERATOR WITH EXTERNAL CHANNELS

(75) Inventors: Victor V. Kulish, Kyjiv (UA); Alexandra C. Melnyk, Powel, OH (US)

(73) Assignee: Viara Research, LLC, Columbus, OH (US)

( * ) Notice: Subject to any disclaimer, the term of this patent is extended or adjusted under 35 U.S.C. 154(b) by 15 days.

(21) Appl. No.: 10/949,633

(22) Filed: Sep. 24, 2004

(51) Int. Cl.
*H05H 7/00* (2006.01)
*H05H 9/00* (2006.01)
*H01J 23/00* (2006.01)

(52) U.S. Cl. ..... 315/505; 315/501; 315/507; 250/491.1

(58) Field of Classification Search ..... 315/500–501, 315/505–507, 111.61; 250/491.1, 396 R
See application file for complete search history.

(56) References Cited

U.S. PATENT DOCUMENTS 6,433,494 B1 * 8/2002 Kulish et al. ..... 315/500
6,580,084 B1 * 6/2003 Hiramoto et al. ..... 250/505.1
6,653,640 B1 * 11/2003 Kulish et al. ..... 250/491.1
2002/0109472 A1 * 8/2002 Kulish et al. ..... 315/505
2005/0200321 A1 * 9/2005 Kulish et al. ..... 315/505
2005/0200322 A1 * 9/2005 Kulish et al. ..... 315/505

* cited by examiner

*Primary Examiner*—Wilson Lee
*Assistant Examiner*—Tung Le
(74) *Attorney, Agent, or Firm*—Mueller and Smith, LPA

(57) ABSTRACT

The invention addresses a multi-channel induction accelerator with external channels, which in its broadest form includes an injector block, a drive system, a block of output systems, and a multi-channel induction accelerative block. The multi-channel induction accelerative block is formed of an aggregate of linear induction acceleration blocks (including those that are placed parallel one with respect to the other), each acceleration block being formed from a sequence of linearly connected acceleration sections. Each acceleration section comprises one or more magnetic inductors enveloped by a conductive screening. One or more inner accelerative channels are placed axially within the inner parts of the conductive screening and have one or more azimuthally oriented slits. One or more channel electrodes are connected electrically with different parts of the inner parts of the conductive screening that are separated by the slit.

12 Claims, 19 Drawing Sheets

MULTI-CHANNEL INDUCTION ACCELERATOR WITH EXTERNAL CHANNELS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention concerns acceleration engineering, and is especially addressed to induction accelerators. It has application as a commercial-type compact powerful accelerator of charged particles for the formation of relativistic beams of charged particles and for the system of many multi-component beams.

There is known an induction accelerator, which can be used as a device for the formation of singular electronic relativistic beams. See, Redinato L. "The advanced test accelerator (ATA), a 50-MeV, 10-kA Induction Linac". *IEEE Trans.*, NS-30, No 4, pp. 2970–2973, 1983. This device also is called the one-channel linear induction accelerator (OLINIAC). The OLINIAC composed of an injector block, a drive system, an output system, and a one-channel linear induction acceleration block. Its peculiarity is that the linear induction acceleration block is made in the form of a sequence of linearly connected acceleration sections. Each of the acceleration sections is made in the form of one or more magnetic inductors, which are enveloped by a conductive screen. Therein, one inner accelerative channel is axially placed within the inner parts of the conductive sleeves, which have corresponding apertures and slits. Channel electrodes are electrically connected with different parts of the conductive screens' inner parts, which are separated by the previously mentioned slits. Owing to this, an axially oriented accelerative electric field is generated between each pair of the channel electrodes.

Thus, the specific feature of the OLINIAC is that the acceleration space is made as a special break (slit) in the inner part of the conductive screen connected with the system of electrodes. That special break is accomplished in the form of the above-noted azimuthally oriented slits. The conductive screen, as a whole, shields the outside of the acceleration section from penetration of the vortex electric field generated inside. This means that the field exists within the inner bulk of the accelerative section only, including the above-mentioned slit in the inner part of the conductive screen. As a result the accelerative electric field is generated between the slit edges. The field is accelerative with respect to the charged particle beam. I other words, the azimuthally oriented inner slits plays a role of the acceleration space for the accelerating the charged particle beam.

The acceleration channel in the OLINIAC has a linear form. This is the main cause why this systems are called "linear".

The large linear (longitudinal) dimensions, relatively low efficiency, limited functional potentialities, and limited range of the current strength of the accelerated beam are the basic shortcoming of the OLINIAC.

The large dimensions of the OLINIAC (e.g. 60–70 m length for the ATA class) are related to its moderate rates of linear acceleration. The typical energy rates of acceleration for the OLINIAC are ~0.7–1.5 MeV/m. The acceleration rate for the ATA example described above is ~0.75 MeV/m. As a result, the total length of the experimental ATA is ~70 m. For a typical commercial system having an output energy ~10 MeV, the total length would be ~15 m. This causes a strong complication in the system's overall infrastructure and accommodation, radiation-protection means, and service system. As a result, commercial application of OLINIAC as a basic construction element for various types of commercial devices becomes economically unsuitable because of their excessive price.

The other shortcoming the OLINIAC is that, only one charged particle beam is accelerated at all stages of the acceleration process, i.e., the OLINIAC is the one-channel and, at the same time, one-beam system. However, a series of practical applications requires the formation of charged-particle beams with multi-component structure. For example, one such application is the electron beam for the two-stream superheterodyne free electron lasers (TSFEL), wherein two-velocity relativistic beams are used. Other examples include various systems for forming complex electron-ion or ion-ion beams. This means that the OLINIAC possesses limited functional possibilities with respect to its potential field of application.

It is well-known that the limited range of beam current strength in the OLINIAC is determined by a few simultaneous causes. It is well known that the limitations for the OLINIAC's range of beam current strength exist from the "down" as well as the "up".

Three main causes for the limited range of beam current strength can be found. The first cause is connected to design and physical limitations characteristic for the chosen type of charged particle injectors. The greater is the beam current the more limited the range of beam current strength becomes. These limitations may be classified as the "limitations from the up".

The second cause is connected to "limitations from the down", which is connected with lower level of its efficiency in the case when the beam current magnitude is too low. The OLINIAC's main power losses $P_{los}$, which are related to the losses on remagnetization of the inductor magnetic cores, determine the OLINIAC's efficiency. These losses depend mainly on the core material and do not practically depend on current beam strength. On the other hand, the useful power $P_{us}$ is the power that the beam obtains during the acceleration process. In contrast to the main power losses, the useful power depends strongly on beam current. As it is widely known, the particle efficiency $\eta_p$ of the acceleration process is determined as a ratio of the useful power $P_{us}$ to the total power $$\eta_P = \frac{P_{us}}{P_{us} + P_{los}}. \tag{1}$$

This means that the main method of the efficiency increasing in this case is to increase the beam current. As experience shows, the power of losses became approximately equal to the useful power when the current beam ~1 kA. Owing to this, the modern, high efficiency OLINIACs are characterized by a beam current ≧1 kA. The beam current for the above mentioned ATA is 10 kA.

Thus, the peculiar "limitation from the down" exists for the OLINIAC beam current. However, many practical applications require acceleration of beams of tens-hundreds of Amperes. At the same time, these applications simultaneously require high efficiency of the acceleration process. The OLINIAC does not satisfy these requirements.

The third cause of the current limitation is connected with inclination of the high current beams to excitation of the beam instabilities. Therein, the probability of instability excitation increases with increasing beam current density.

The fourth cause of the current limitation is related to the phenomenon of beam critical current. The critical current is a maximal current beam which can pass through the given accelerative channel. As a result, the formation and the acceleration of electron and ion beams, which are characterized by current of a few hundred kA and more, becomes a complicated technological problem in the case of OLINIAC.

Induction accelerators, called multi-channel induction accelerators (MIAC), may be used for formation of relativistic charged particle beams and systems of charged particle beams. Two versions of MIACs are known. Including, the multi-channel linear induction accelerator (MLINIAC) [V. V. Kulish and A. C. Melnyk. Multi-channel Linear Induction Accelerator, U.S. Pat. No. 6,653,640 B2, Date of patent Nov. 25, 2003] and the undulative EH-Accelerator [V. V. Kulish et. al. EH-accelerator, U.S. Pat. No. 6,433,494 B1, Date of patent Aug. 13, 2001; V. V. Kulish. Hierarchical methods. V. II, Undulative electromagnetic systems. Kluwer Academic Publishers, Boston/Dordrecht/London, 2002]. The latter also is called the multi-channel undulative induction accelerator (MUNIAC).

The MIAC consists of an injector block, a drive system, an output system, and a multi-channel induction accelerative block. For this system, the multi-channel induction acceleration block is formed as an aggregate of separate one-channel linear induction acceleration blocks, including those that are placed parallel with one another like those used in the OLINIAC. Like the OLINIAC, each one-channel linear induction acceleration block is formed as a sequence of linearly connected acceleration sections. Therein, each one-channel linear induction accelerative block contains only one inner accelerative channel. For example, all channels are placed axially within the inner parts of the conductive screens that have the inner slits. As with the OLINIAC, these slits play a role of accelerative spaces for the charged particle beams. Each inner channel electrode pair is electrically connected with corresponding inner parts of the conductive screens that are divided by the slit.

The MLINIAC differs from the MUNIAC in its block of output systems. In the case of MLINIAC this block is formed as an aggregate of partial outlet devices that are connected with the linear inner accelerative channels. These partial outlet devices may be the diaphragms, which separate the working volume vacuum from outside atmosphere, various control systems, which direct the beams in a chosen direction, compression or decompression systems, etc. These partial outlet devices also may be systems for merging together different partial beams of charged particles consisting of the same kind of particles as well as of a different particles, including, electrons and positive and negative ions.

In contrast to the MLINIAC, at least some of the MUNIAC's partial output devices are made in the form of turning systems, which connect outputs of one inner accelerative channels with inputs of other inner channels. Those inputs connected with injectors and those for expelling the accelerated particle beams are exceptions from this rule. Thus, each complete (i.e., continuous) acceleration channel in the MUNIAC represents by itself a sequence of linear inner accelerative channel and the channels within the turning systems, where beams turn at a 180° angle every time. This gives the accelerative charged particle beam an undulative-like form. In this connection the systems of this class are referred to as undulative.

Also known the MIAC with a mixed design of output systems.

Thus, the common feature of the MLINIAC and MUNIAC is that both contain the multi-channel accelerative blocks with inner accelerative channels. These blocks are formed as an aggregate of one-channel linear induction acceleration blocks, including those that are oriented parallel to one another. The dissimilarities are the designs' block of output systems.

These designs are not always competitors and each has optimal applications. For instance, the most promising MLINIAC application involves different types of especially powerful devices destined for generation relativistic charged particle beams, including those consisting of charged particles of different kind. In commercial applications, the beams are usually characterized by relatively low magnitudes of energy (not higher than 10 MeV) and very high magnitudes of total current including all beam components (tens–hundreds kA). The main merit of the MUNIAC is its relative compactness. For instance, using the MUNIAC design scheme with five turns, the total length of the above-described ATA-type OLINIAC can be reduced from the ~70 m to ~13 m. With this system, the total beam current could be increased, in principle, for a few times owing to application of the multi-channel design scheme. On the other hand, the MUNIAC design turns out to be too complicated in the case of forming complex beams consist of charged particles of different charge. Beside that, the MLINIAC-design has advantages over the MUNIAC in commercial cases when the beam energy does not exceed ~5 MeV. Thus, the multi-channel induction accelerator (MIAC) partially solves problems characteristic of the OLINIAC. However, other problems are not satisfactory solved. Namely, the MIAC design is heavy. This can be explained by the increased total mass of the inductor magnetic cores used. The result is that the MIAC are very expensive. Apart from that, they have relatively low efficiency like the OLINIAC,.

BRIEF SUMMARY OF THE INVENTION

The MIAC is most similar to the invention proposed with respect to the technological essence and the achieved result. The aim of the invention is to construct a commercial-type multi-channel induction accelerator with external channels (MIACE), which is characterized by lower weight and cost and, at the same time, higher efficiency.

The aim is attained with a multi-channel induction accelerator with external channels (MIACE), comprising:

an injector block, a drive system, a block of output systems; and a multi-channel induction accelerative block formed of an aggregate of linear induction acceleration blocks (including those that are placed parallel one with respect to the other), each acceleration block comprising a sequence of linearly connected acceleration sections, each acceleration section comprising one or more magnetic inductors enveloped by a conductive screening, wherein one or more inner accelerative channels are placed axially within the inner parts of the conductive screening and which have one or more azimuthally oriented slits, and wherein one or more channel electrodes are connected electrically with different parts of the inner parts of the conductive screening that are separated by the slit. Additionally, the multi-channel induction accelerator with external channels may further comprise at least one external acceleration channel oriented axially along the external parts of the conducting screens and having one or more electrodes, at least one of the azimuthally-oriented slits is made in the external parts of the conducting screen and the electrodes of the external acceleration channel are connected electrically with different parts of the external parts of the screens separated by the slit.

Ten different design versions of the MIACE are disclosed herein.

The first design version is distinguished by the fact that wherein at least one block of the output systems consists of a block of solenoidal turning systems. At least one of these solenoidal turning systems connects the inner acceleration channels with the external acceleration channels.

In the second design version, the block of output systems is made as an aggregate of outlet devices for the partial beams, which are accelerated within the inner, as well as, external liner accelerative channels.

In the third design version, at least two parallel linear induction acceleration blocks are connected electrically with the same external accelerative channel in such a manner that each pair of electrodes of this channel that is connected with the first linear induction acceleration block (excluding the outermost electrodes) is placed between two pairs of analogous electrodes of the second linear induction acceleration block and vice versa.

In the fourth design version, the injectors comprise devices for generation of beams of charged particles with opposite electrical signs.

In the fifth design version, the injectors comprise devices for generation of beams of charged particles with the same electrical sign and are capable of operating in a trigger mode.

In the sixth design version, at least one of the injectors of the injector block comprises an induction multi-beam charged particle injector, wherein cathodes and anodes are placed within the azimuthal slits in the external part of the conductive screening.

In the seventh design version, at least one of the injectors of the injector block comprises an induction multi-beam charged particle injector, wherein at least two cathodes and two anodes are placed within the accelerative space between the inner part of the conductive screening.

In the eighth design version, the multi-channel induction accelerator with external channels comprises at least two linear induction acceleration blocks, each of which comprises at least two inner accelerative channels. The solenoidal magnetic turning systems connect the inner accelerative channels of different linear induction acceleration blocks.

In the ninth design version, the multi-channel induction accelerative block is placed in the coaxial manner within at least one of the external magnetic inductors. A conducting screen envelops this external magnetic inductor. The azimuthally-oriented slit is made in the inner parts of the screen. The electrodes, which are connected electrically with different parts of this screen and which are separated by the slit, is connected with the electrodes of the external channels.

In the tenth design version, the induction multi-beam charged particle injector is placed in the coaxial manner within at least one of external magnetic inductors. A conducting screen envelops this external magnetic inductor. The azimuthally-oriented slit is made in the inner parts of the screen. The electrodes, which are connected electrically with different parts of this screen and which are separated by the slit, are connected with the electrodes of the induction multi-beam charged particle injector.

Building the multi-channel induction accelerator with external channels (MIACE), including the above-described structural variants from the multi-channel induction accelerative block, achieves the following advantages. Namely, the same inductors are used here at least two times. The inductors generate the accelerative electric field in the inner accelerative channels, while simultaneously generating the accelerative field in the external accelerative channels. This means that, with the same power of losses for remagnetizing the cores, $P_{los}$, the useful power, $P_{us}$, is larger. As a result, the device efficiency turns out to be higher the prototype efficiency.

It should be noted that the number of linear external and inner accelerative channels here is larger than the number of linear induction acceleration blocks. This means that, for attaining the same acceleration, less magnetic material (for the cores manufacturing) is required. Hence, essentially lower cost and lower weight characterize the inventive device because modern magnetic materials (metglasses or ferrites) are very expensive and heavy.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

Figure 1:
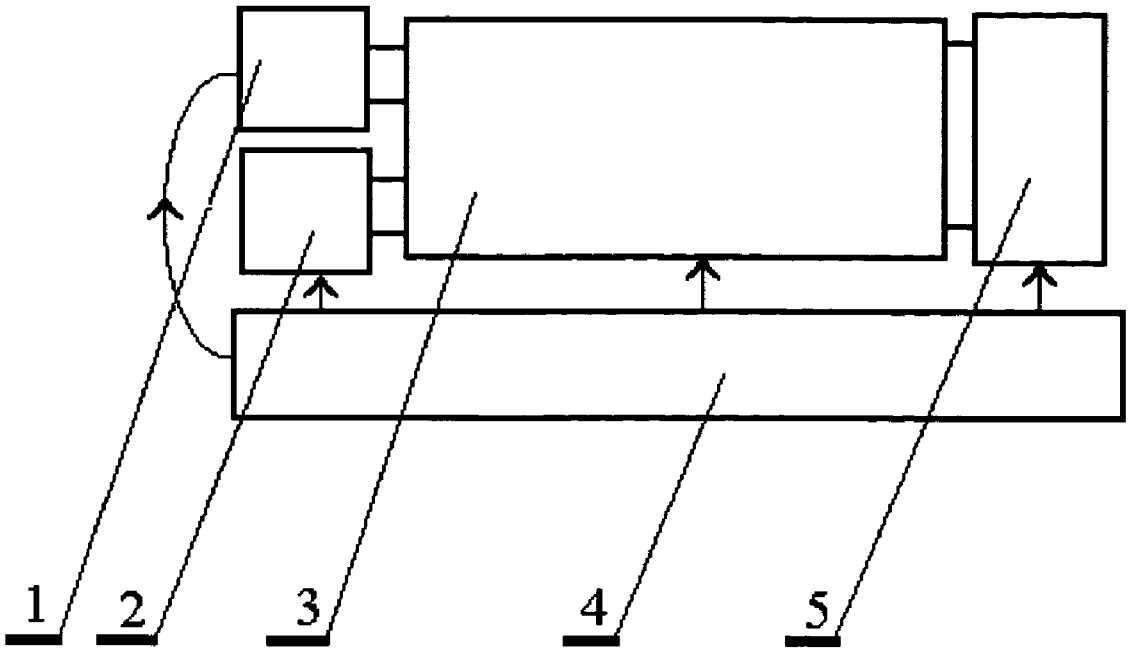
FIG. 1 is a schematic representative of the structural electric scheme of the multi-channel induction accelerator with external channels (MIACE)

The multi-channel induction accelerator with external channels (MIACE, see FIG. 1) comprises the injector block 1 and the first part of the block of output systems 2, which are attached to the multi-channel induction accelerative block with external channels 3 from one side. The drive source 4 is attaches to the blocks 1–3 and, at the same time, to the second part of the block of output systems 5.

Injector block 1 is made in the form of separate or of an aggregate of separate electron and ion injectors. Drive system 4 has a standard design. Multi-channel induction acceleration block 3 is made in a form of an aggregate of separate linear induction acceleration blocks. Each such block has one or more the external accelerative channels. Besides that, each such blocks has one or more the inner accelerative channels.

The first and the second parts of the block of output system, at 2 and 5, respectively, may include partial output devices with different designs. The form of these devices will depend on the design version of the MIACE. In the case where all partial output devices are made in the form of outlets for the partial accelerated linear beams, the MLINIACE design version is realized. The first part of the output systems, 2, is not present in this case. The second part, 5, is made as an aggregate of partial outlets for the partial linear accelerated beams, as mentioned above. These partial outlet devices may be the diaphragms, which separate the working volume vacuum from outside atmosphere, various control systems, which direct and form the beams in a chosen direction, compression or decompression systems, etc. The partial outlet devices also may be systems for merging together different partial beams of charged particles consisting of the same kind of particles as well as different particles, including, electrons and positive and negative ions.

Part of the partial output devices can be also made in the form of the magnetic or solenoidal turning systems—the case of the MUNIACE. At least one of them, therein, connects the inner and external channels.

A mixed type of the MIACE design version takes place in the general case, combining design characteristics of the MUNIACE, and the MLINIACE.

Figure 2:
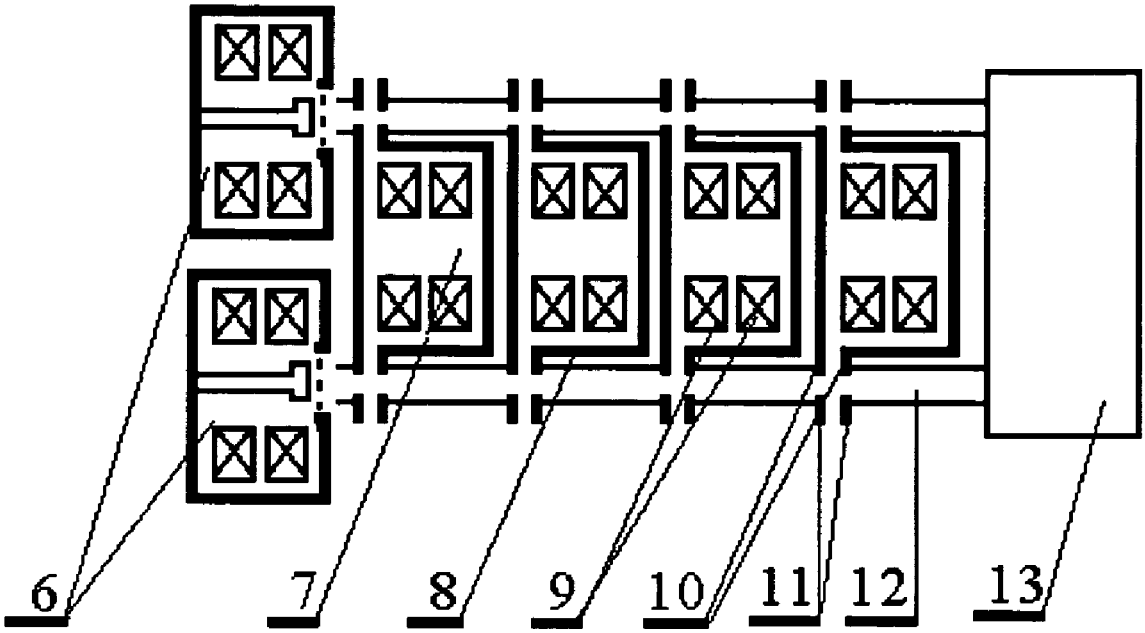
FIG. 2 schematically shows the structure of a linear MIACE with four external channels in the frontal projection.

FIG. 2 shows an example of the structure of a MLINIACE with four (or more) external channels. Illustrated in that figure are injectors, 6, of charged particle beams (electrons or ions), accelerative sections, 7, electric screens, 8, magnetic inductors, 9, slits, 10, in the screens 8. FIG. 2 also shows accelerative spaces, 11, in the external accelerative channels, 12. A block of output systems is shown at 13. Magnetic inductors can be made on the basis of ferrite or METGLASS cores (or other similar magnetic materials) or on the basis without-core superconductive solenoidal systems. The first variant is destined for ground-basing systems. The second variant is more promising for mobile systems, including, airborne or spaceborne ones.

The injectors 6 are connected with the inputs of linear accelerative channels 12. The azimuthal slits 10 are made in the external part of screens 8. Electrical electrodes, which form the accelerative spaces within the channels 12, are connected with different sides of slits 10. The outputs of all four channels 12 are connected with the block of output systems 13.

Figure 3:
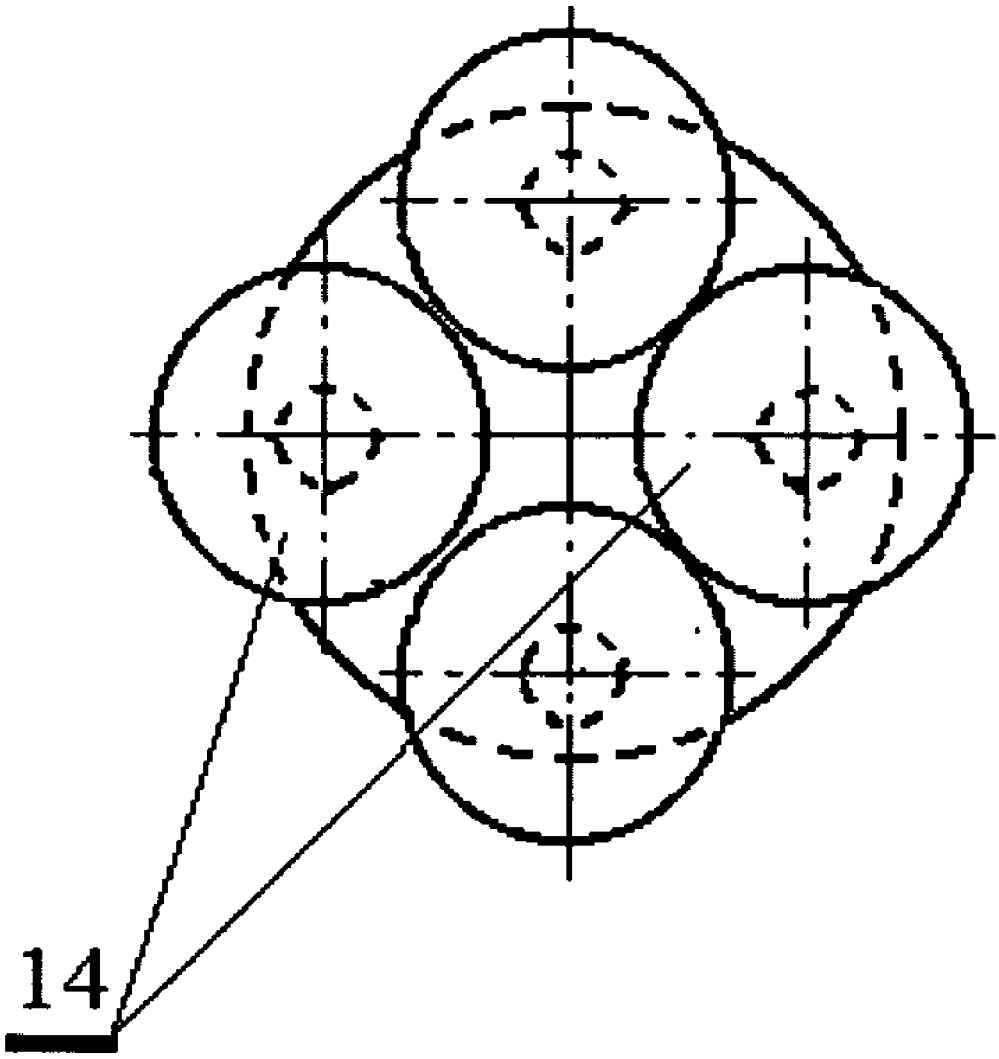
FIG. 3 is the cross-section view of the MIACE shown in FIG. 2.

A profile projection of the same design is shown in FIG. 3. Here 14 are the separate linear induction acceleration blocks of block 3 (FIG. 1). The dotted line corresponds to the profile projection of accelerative sections 7 (FIG. 2). The solid lines picture the profile projection of the injectors 6 (FIG. 2).

Figure 4:
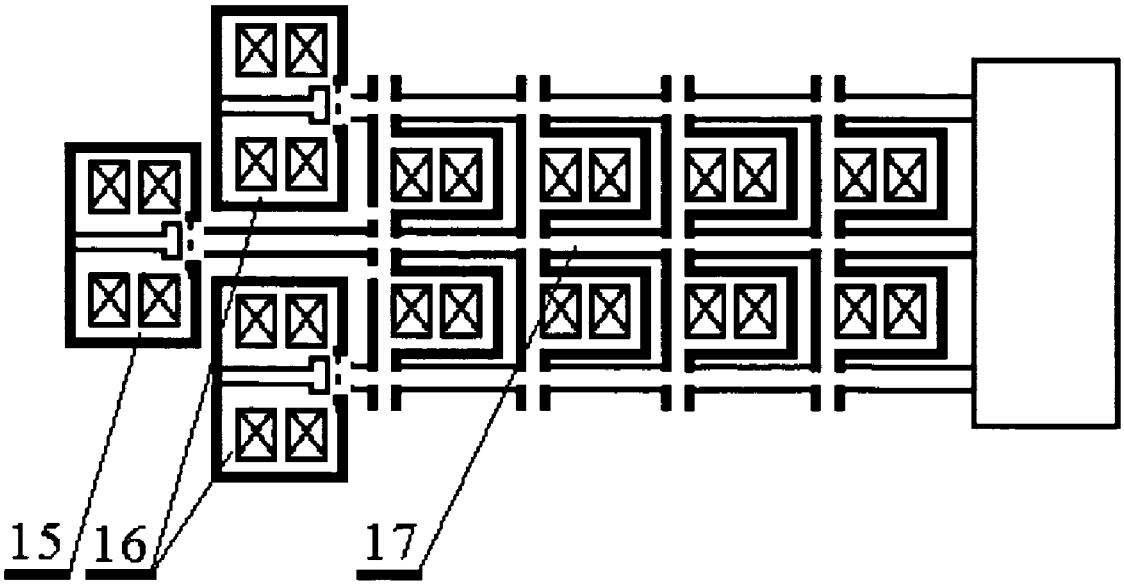
FIG. 4 schematically shows the structure of another embodiment of the linear MIACE with four external and one inner channel.

FIG. 4 shows the structure of another embodiment of the linear MIACE with four (or more) external and one inner channels. That figure shows charged particle injectors, 15 and 16, and an inner accelerative channel, 17. Other elements are the same as shown previously in FIGS. 2 and 3. The specific feature of this design is that the injectors 16 are connected with the external channels (similarly to the preceding design versions), and, at the same time, injector 15 is connected with the inner channel 17.

Figure 5:
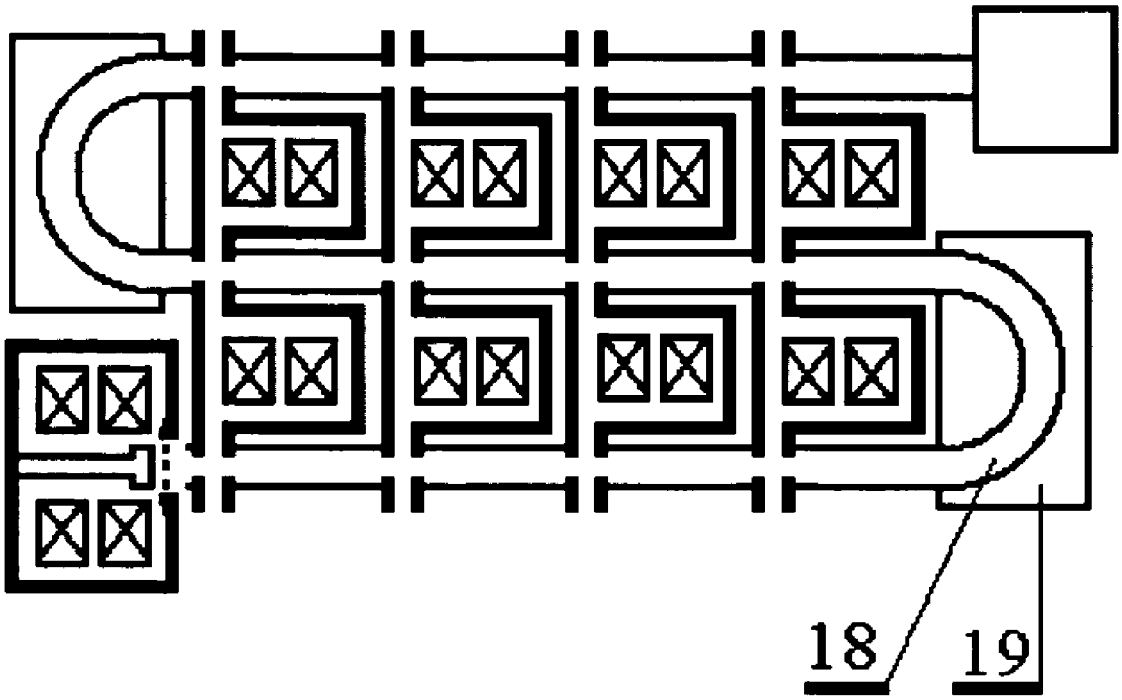
FIG. 5 schematically shows the structure of the undulative MIACE with two external channels and one inner channel.

FIG. 5 schematically shows the structure of the MIUNACE with two external channels and one inner channel. Here 18 are the turning parts of the accelerative channel, 19 are the turning systems, which include the turning parts 18, in particular. The turning parts 18 connect the linear inner 17 (FIG. 4) partial accelerative channel with the linear also external 12 (FIG. 2) accelerative channels. As a result, a united (complete) undulative accelerative channel is formed. Turning systems 19 can be made in accordance with the solenoidal ore magnetic designs. This means that at least one of turning systems is formed as a combination of straight and curvilinear solenoid sections. Another relevant design variant is the combination of solenoid sections (linear as well as curvilinear) and turning magnets. In any case, the turning system provides turn of the accelerated charged particle beam for 180°. Other elements are the same as shown previously in FIGS. 2–4.

Figure 6:
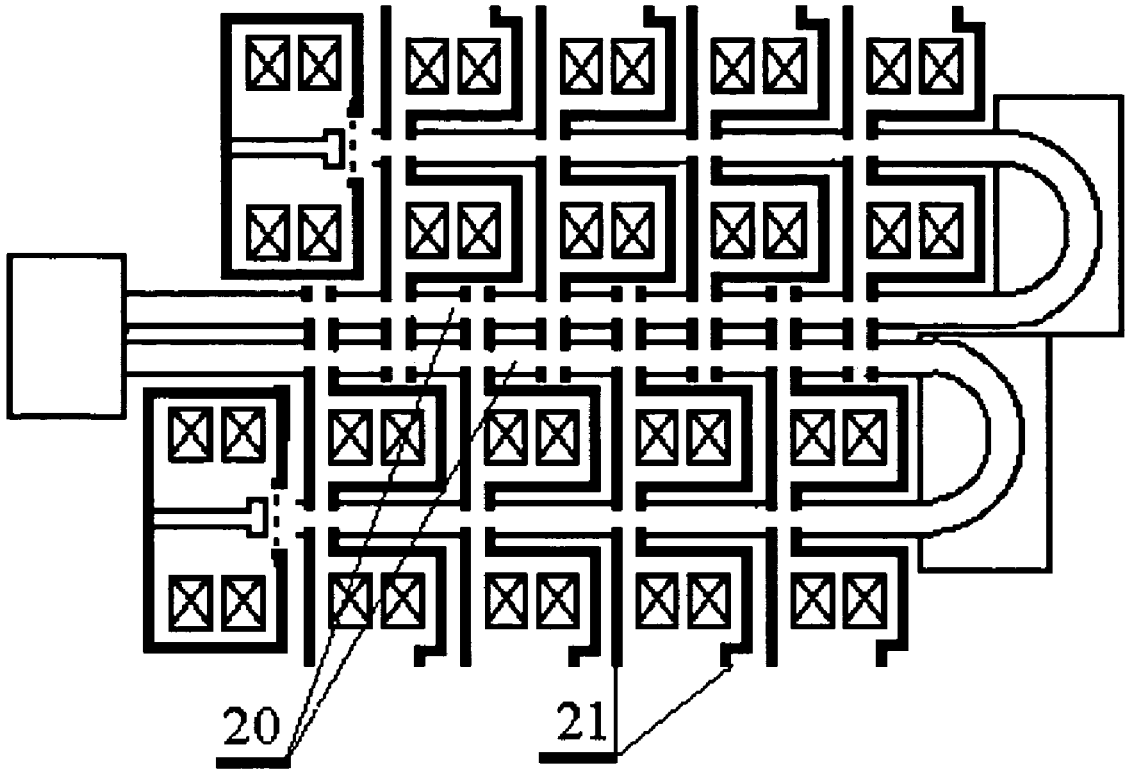
FIG. 6 schematically shows the structure of another embodiment of the MIACE having a multi-channel induction accelerative block that includes two blocks, such as those shown in FIG. 2, connected in series with respect to the common external channel.

FIG. 6 schematically shows the structure of another embodiment of the MIACE having a multi-channel induction accelerative block that includes two blocks, such as those shown in FIG. 2, electrically connected in series. Here, common accelerative channels, 20, belong, at the same time, to the first block, as well as to the second one. Item 21 illustrates the design idea of screen-concentrators, which are used in this design version. The slits in conductive screens 8 (see FIG. 2) are much wider in its non-working part and are minimal in the region of accelerative electrodes. This is made for the sake of essential increasing the voltage in the external accelerative spaces in external channels 20. Here both channels are shown for convenience in the plane of the drawing. But, really they are placed in the perpendicular plane. Other elements are the same as shown previously in FIGS. 2–5.

Figure 7:
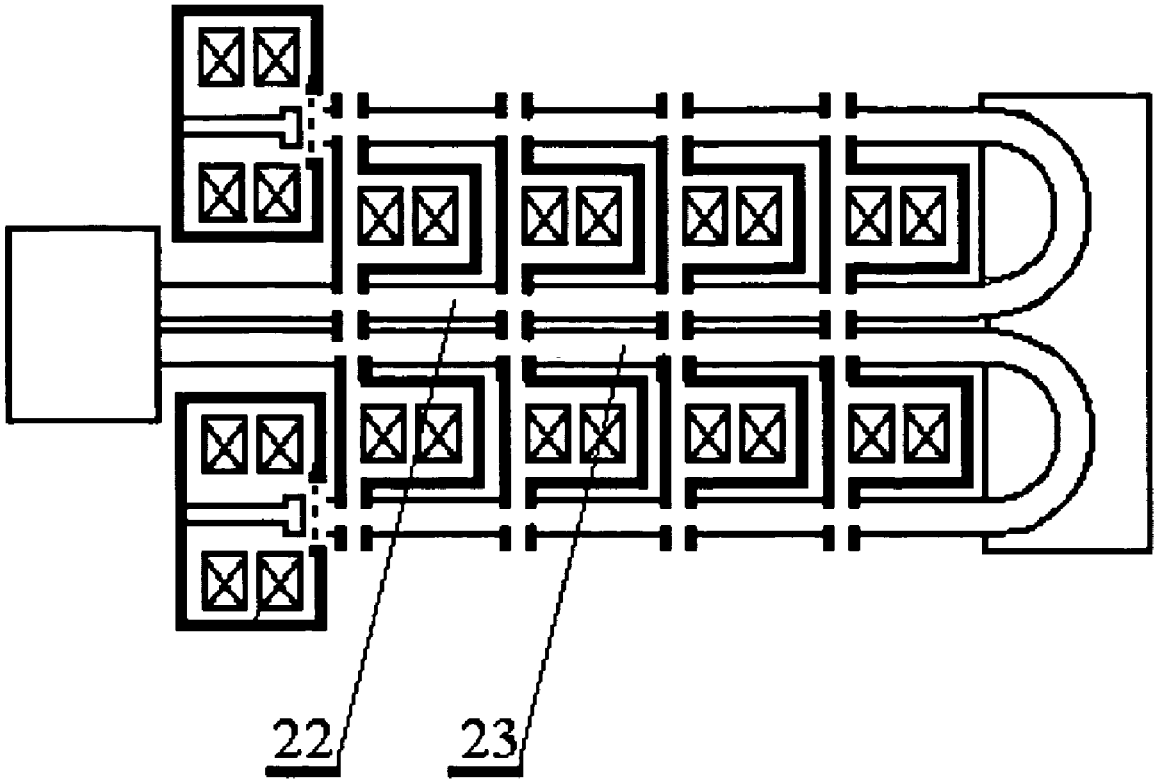
FIG. 7 schematically shows the structure of the undulative MIACE with more than one external channels and more than one inner channels and with two one-beam charged particle injectors.

FIG. 7 shows the structure of the MIUNACE with more than one external channel and more than one inner channel and with several (two, for example) one-beam charged particle injectors. Three different design variants, distinguished by the arrangement of the inner channels, are proposed for the design version of the MUNIACE like that shown in FIG. 7. The first is the design variant wherein the number of inner channels is two or more. There, each inner channel like 22, 23, is connected with its "personal" external channel. The second variant is peculiar in that two or more external channels are connected with the same inner channel. The turning system (see the item 5 in FIG. 1) additionally carries out the system role of merging together several external charged particle beams into one inner beam. Finally, the third design version can be classified as a mixed version. The characteristic feature of this design version is that the number of the inner channels does not coincide with the number of external channels. Other elements are the same as shown previously in FIGS. 2–6.

Figure 8:
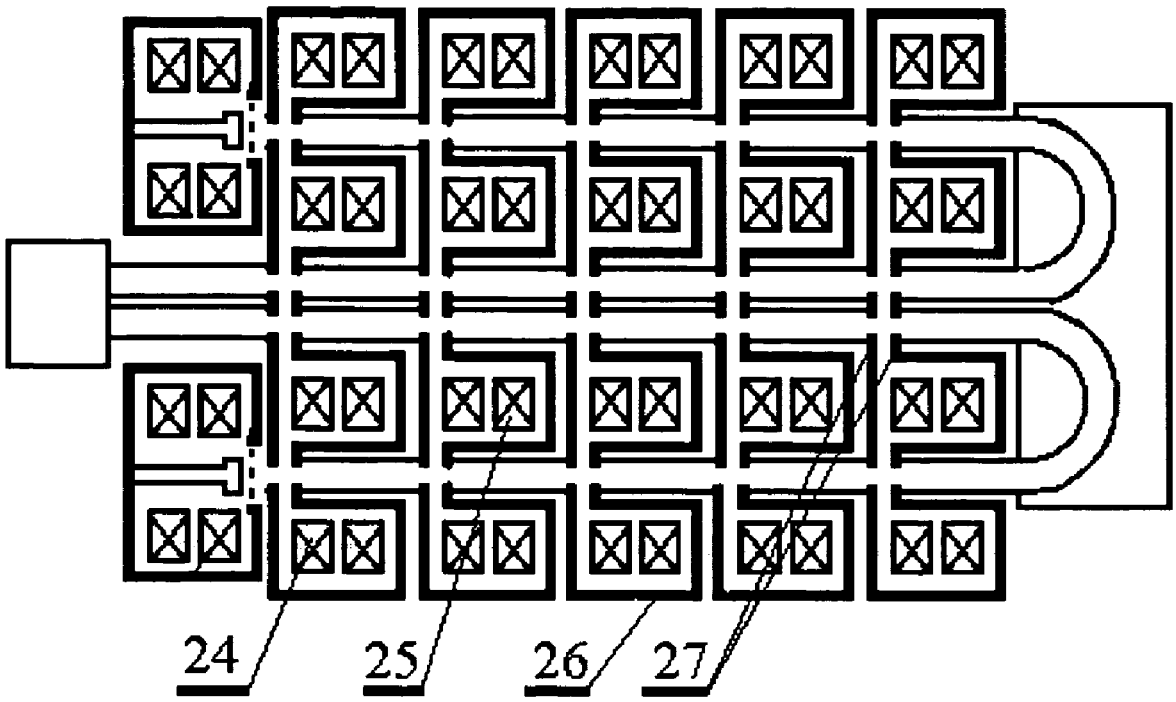
FIG. 8 schematically shows the structure of the undulative MIACE, where the MIACE, like that shown in FIG. 7, is placed coaxially within the external inductors with inner accelerative electrodes.

FIG. 8 shows the analogous structure of the MIUNACE, which additionally comprises external inductors with conductive screens. Here 24 are the external inductors, 25 are the inner inductors, 26 are the external conductive screens. Electrodes 27 are connected with the inner slit within external conductive screen 26.

Thus, the design shown in FIG. 8 can be treated as a MIACE, which is like the device shown in FIG. 7, which, in accordance with the coaxial design scheme, is placed within external inductors 24. External inductors 24 are enveloped by an additional conductive screen 26 where a slit is made in its inner part. Similarly to other above discussed design versions, electrodes 27 are connected electrically with the edges of this slit. At the same time, electrodes 27 are connected with external accelerative channels 12 (FIG. 2). Therein, two design variants of this connection are proposed. The first is the parallel connection, where electrodes 27 are connected with electrodes 11 (FIG. 2) in the parallel manner. Just this design variant is shown in FIG. 8. The second design variant is based on the scheme of connection in series. Such scheme of connection is like that that is shown in FIG. 6. Other elements are the same as shown previously in FIGS. 2–7.

Two design variants for placing electrodes within the external channels are proposed. In the first case, the electrodes 27 are connected parallel with the external electrodes 11 (FIG. 2). In the second case both types of electrodes are connected with external accelerative channel 12 (FIG. 2) in series, like that design scheme shown in FIG. 6. Essential increasing of the acceleration rate is attained in both these cases.

Figure 9:
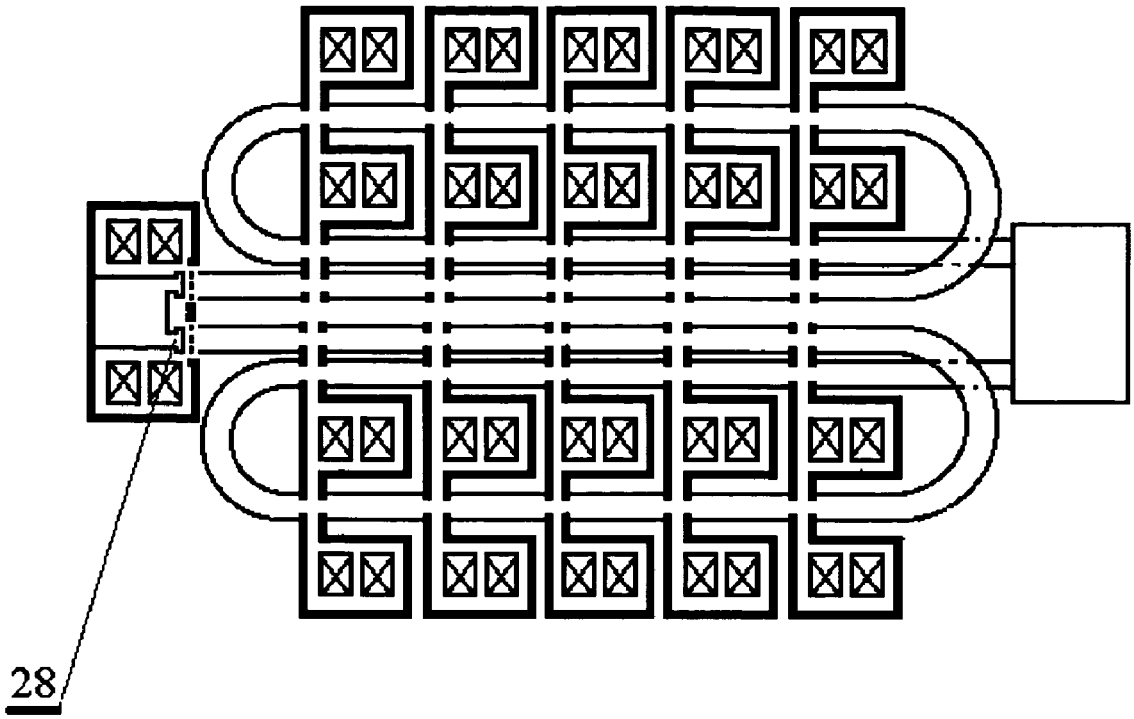
FIG. 9 schematically shows the structure of the undulative MIACE with the external inductors, comprised two and more external channels and four and more inner channels and two-beam charged particle injectors.

FIG. 9 shows the structure of another design version of the MIUNACE shown above in FIG. 8. The characteristic feature of this design version is that it comprises the turning systems placed opposite both sides of the multi-channel induction accelerative block 3 (see FIG. 1). Apart from that, partial design solutions are once more illustrated there. This is the design of a multi-beam induction injector 28 with inner placing cathodes and anodes. Such arrangement of injector 28 solves the design problem of generation of many parallel partial beams with small distance between the beams. This problem arises in the case of the use of many separate one-beam injectors for generation of the mentioned multi-component beams because the cross size of any such injector is not small. The partial design proposed solves this problem. Other elements are the same as shown previously in FIGS. 2–8.

Figure 10:
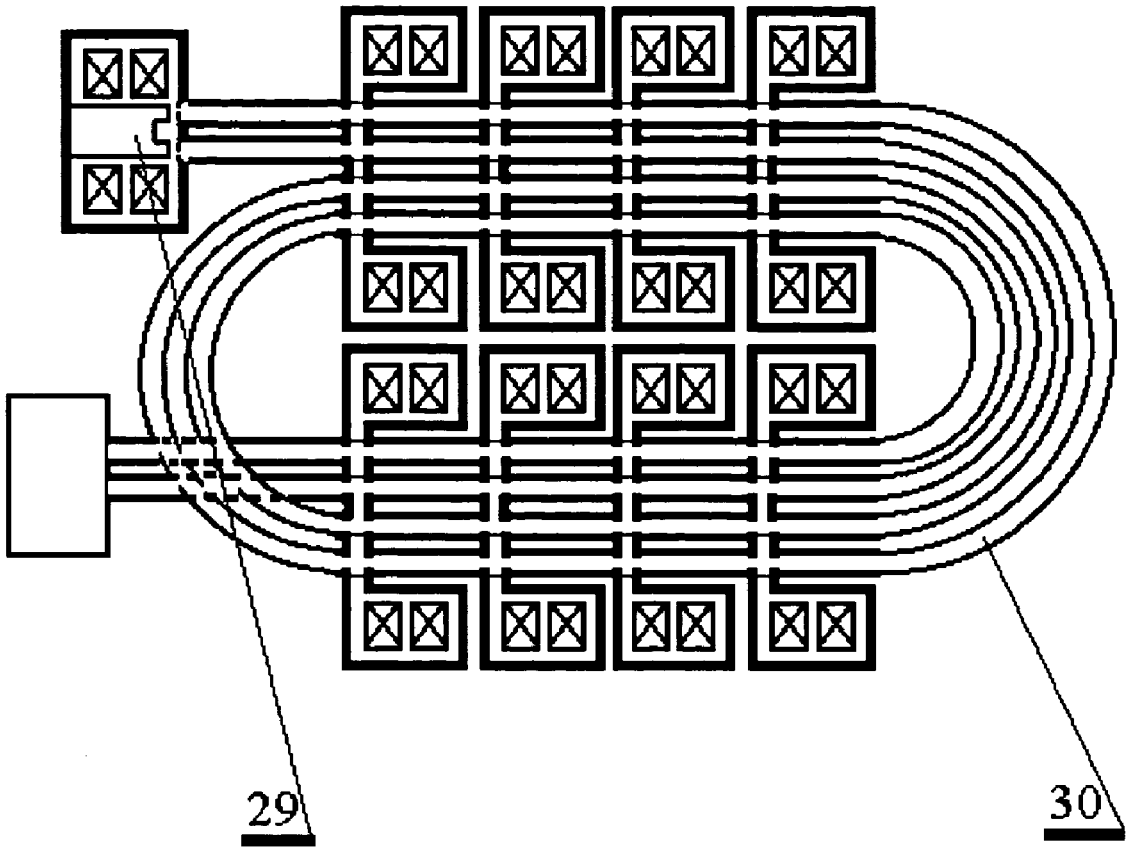
FIG. 10 schematically shows the structure of the undulative MIACE with two separate four-channel linear induction acceleration blocks connected by the solenoidal turning systems.

The design version shown in FIG. 10 is characterized by the use of an analogous multi-beam injector with inner cathodes and anodes and, at the same time, many turning systems like 19 (see FIG. 5). In this case, these turning systems connect the inner channels of different (two, for instance, as shown in FIG. 10) inductional acceleration blocks. Three design variants are proposed. The first of them is characterized by the number of beams, generated by the injector 28, which equals the number of the accelerated output beams. This partial variant is illustrated in FIG. 10. It should be mentioned that all inner channels there are shown for convenience as placed in the same plane. However, in 3-dimenasional space the arrangement of the channel carries a volumetric character. For example, both pairs of channels shown in FIG. 10 may be placed on two parallel planes.

The second design variant is designed for generation of charged particle beams with especially high current. As is known, the problem of generation of hundred-kA beams, first of all, is connected with the problem of critical current. Therein, each partial beam current is smaller in the case discussed than the critical current. The turning systems 30 in this case are made in the form of many (for instance, ten) partial beams. It is used the circumstance that the critical current is smaller the higher is the beam energy. A specific characteristic of the discussed design version in this case is that at least part of the turning systems 30 are formed as systems for merging together of two and more accelerated partial beams. A part of the partial beams are merging together during the turning process after acceleration of these beams in the first inductional acceleration block. The same procedure is accomplished further after acceleration of beams in the second section and so on. As a result, the system generates only one output accelerated beam with hundred-kA charged particle beam.

The third design variant is a mixed one. The number of initial partial beams in this case is larger than the number of output accelerated beams. However, the number of output beams is more than one.

Figure 11:
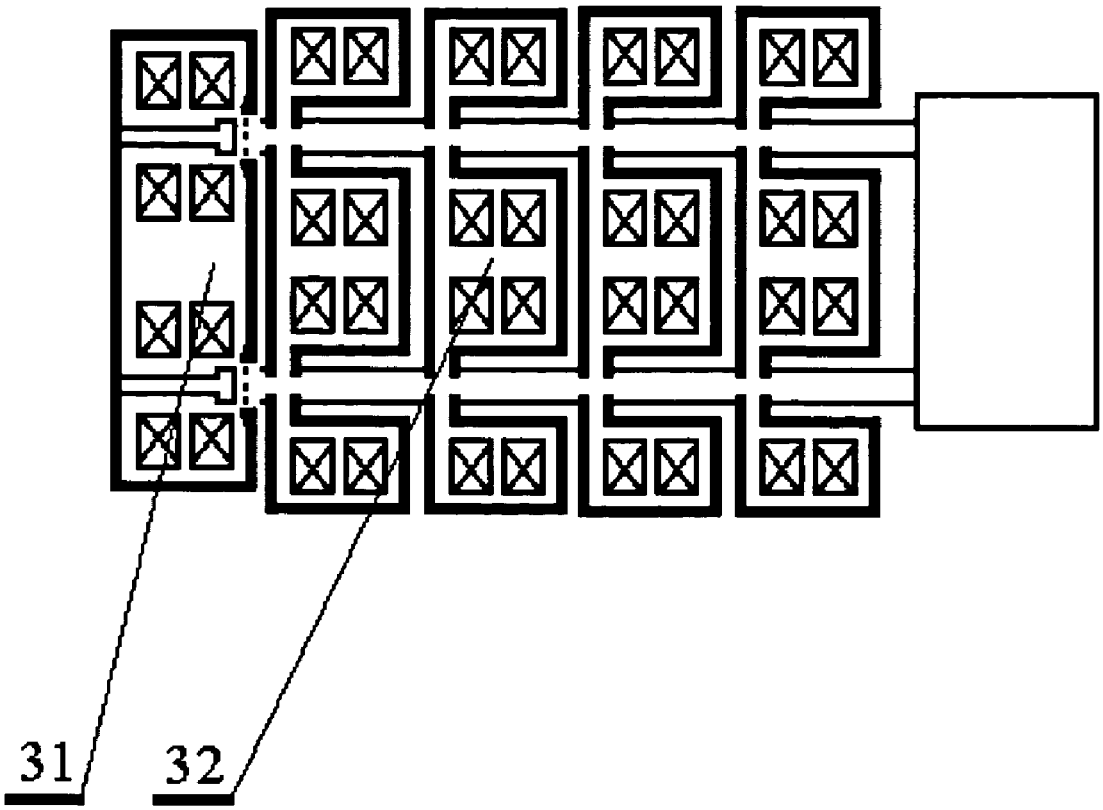
FIG. 11 shows the structure of the multi-channel linear MIACE, where the MIACE like that shown in FIG. 2, is placed coaxially within the external inductors with inner accelerative electrodes and the injector block is formed as a multi-beam injector with external cathodes and anodes, comprising the external inductors with inner electrodes.

FIG. 11 shows the structure of the MILINACE with external inductors. This design version comprises two and more external channels (other external channels are placed beyond the plane of the drawing). Design peculiarity of this device is that the injector block is made in the form of multi-beam injector 31 with external placing of all cathodes and anodes. Besides that, multi-beam injector 31 also contains the external inductor, which encompasses the injector with external cathodes and anodes. Analogously, the external inductors 24, 26 and 27 (FIG. 8) encompass inner inductors 32. Other elements are the same as shown previously in FIGS. 2–10.

The proposed multi-channel induction accelerator with external channels (MIACE) works in the following manner. The injector 1 (see FIG. 1) forms charged particles beam which are directed into the inputs of the partial accelerative channels. Therein, three different design versions can be realized. In the first case, the injectors are connected with the external channels only. Examples of such design versions are shown in FIGS. 2–5, 7, 8, and 11. The connection of the injectors with the inner channels is characteristic of the design version of the second type. See, for example, FIGS. 6, 9 and 10. Finally, the mixed version also can be realized. See, for instance, FIG. 4. But, independent of the type of connections, the beams are accelerated only while passing through the accelerative spaces in the channels within the linear induction acceleration blocks. In the case of the MUNIACE, the accelerated beams change the linear channel during the complete acceleration process. There the beams initially are accelerated in the same linear accelerative channels. Then, they are directed into turning systems 5, 19. After turning these beams are accelerated in other linear channels and so on.

A specific feature of such designs is that the turning systems can connect the channels of any types, i.e., they can connect the inner channels with the external ones (see FIGS. 6 and 9), and, the other way round, the external channels with inner channels (see FIGS. 5, 7, 8). They also can connect the external channels with another external, and the inner channels with inner ones (see FIG. 10). In contrast to the MUNIACE, the accelerated beams never change the linear channels during the beam acceleration in the MLINIACE (see examples in FIGS. 2–4, 11).

Two different working modes of the design, which is shown in FIG. 4 (and other similar partial design variants), can be realized. Injectors 15 and 16, which generate beams consisting of charged particles having different electrical charge characterize the first variant. If, for example, injector 15 generates an electron beam (or a negative-ion beam), then the injectors 16 simultaneously generate the positive-ion beams, and vice versa.

In the second working mode, all injectors generate beams with the same charges. Therein, the drive systems 4 are made in accordance with the so-called trigger-like scheme, i.e., both types of the injectors work in turns. When the beams generated by the first injectors are accelerated, then the second injectors "rest" at this time, and the other way a round.

A working peculiarity of the design version shown in FIG. 5 is that the same inductors here are used simultaneously for acceleration of the same charged particle beam. Therein, the beam acceleration occurs during its successive motion within the external, inner, and external again accelerative channels. This alone allows the same inductor to be used three times for acceleration of the same charged particle beam. As a result, the efficiency of the design increases.

A specific feature of the MIAC with external channel is that that the accelerative voltage on the external electrodes is smaller than the analogous voltage on the inner electrodes. The design version proposed in FIG. 6 particularly solves this problem. Owing to the connection of two or more induction accelerative blocks in series with respect to external accelerative channels 20. The accelerated charged particle beams moving in channels 20 pass, in turns, the accelerative spaces belonging to the first and second induction accelerative blocks, successively. As a result, each of the beams obtains at least two times more energy. Or, in other word, the accelerative rate increases at least two times. In general, the number of blocks connected in series can be more than two. Correspondingly, the total increase in the accelerative rate in such a case can be higher than two times.

The second design solution for increasing the accelerative rate of the external channels is connected with the optimization of the conductive screens' form. Item 21 in FIG. 6 illustrates the design idea of peculiar "screen-concentrators". In this case, the slits in the conductive screens are made much wider in its non-working part and are made minimal in the region of accelerative electrodes. As the physical analysis shows, this allows an essential increase in the density of strength lines of the electric field within the external accelerative spaces and, simultaneously, to decrease it in the non-working part of the slit. As a result, the accelerative voltage on the electrodes increases.

The operation principles of the design version shown in FIG. 7 are similar to the operation principles of the system shown in FIG. 5. The difference is only that here a possibility of simultaneous acceleration of a few independent charged particle beams is illustrated.

The design version shown in FIG. 8 illustrates the third way to solve the problem of increasing the accelerative voltage (and the acceleration rate, respectively). Introducing additional external inductors 24 with additional inner electrodes 27 attains the sought for result. Inductors 24 generate additional accelerative voltage on electrodes 27 within the external accelerative channels 12 (see FIG. 2). As a result, the total accelerative rate increases.

The operation principles of the design version shown in FIG. 9 are similar to the operation principles of the system shown in FIG. 8. The only difference is the presence of an additional block of turning systems, placed on the inductor side of the multi-channel induction accelerative block 3 (see FIG. 1). This, in contrast to the system shown in FIG. 8, gives a possibility to let out the accelerated charged particle beams from the opposite side of the block 3 (see FIG. 1). Such arrangement of the MIACE is most convenient in some practical applications.

The operation principles of the design version shown in FIG. 10 are similar to those described above. Its peculiarity is that all beams accelerate in the inner linear channels many times. However, the acceleration of each beam occurs every time in another inner linear channel.

The specific feature of the design version shown in FIG. 11 is use of the multi-beam injector 31 with external placement of the cathodes and anodes and the use of the external inductor like 24, 26 and 27 shown in FIG. 8. Apart from that, analogous inductors encompasses the multi-channel induction acceleration block 32, like that is shown in FIG. 2. In contrast to the situation with the injectors with inner cathodes and anodes like 28, 29 (see FIGS. 9 and 10, respectively), the injectors proposed are destined for generation of many parallel beams in the arrangement with large radial distance between opposite partial beams.

The operation principles of this system are similar to the operation principles of the system shown in FIG. 2. The only difference is that, here, the accelerating beams are found additionally under the accelerative influence of the electric field generated by the external inductors. Owing to this, the total accelerative rate increases essentially.

A most promising area of utilization of this design version is especially powerful (units MWt of mean power) systems with especially high-current (hundred kA) output beams. This is explained by the fact that this design is very developed spatially. It allows, in particular, to solve by more simple means various design problems, which are characteristic for the prior art. These problems include, for example, heat, critical current, efficiency, and reliability, etc.

The basic physical ideas and physical meaning of main working processes in the MIACE are illustrated in FIGS. 12–19.

Figure 12:
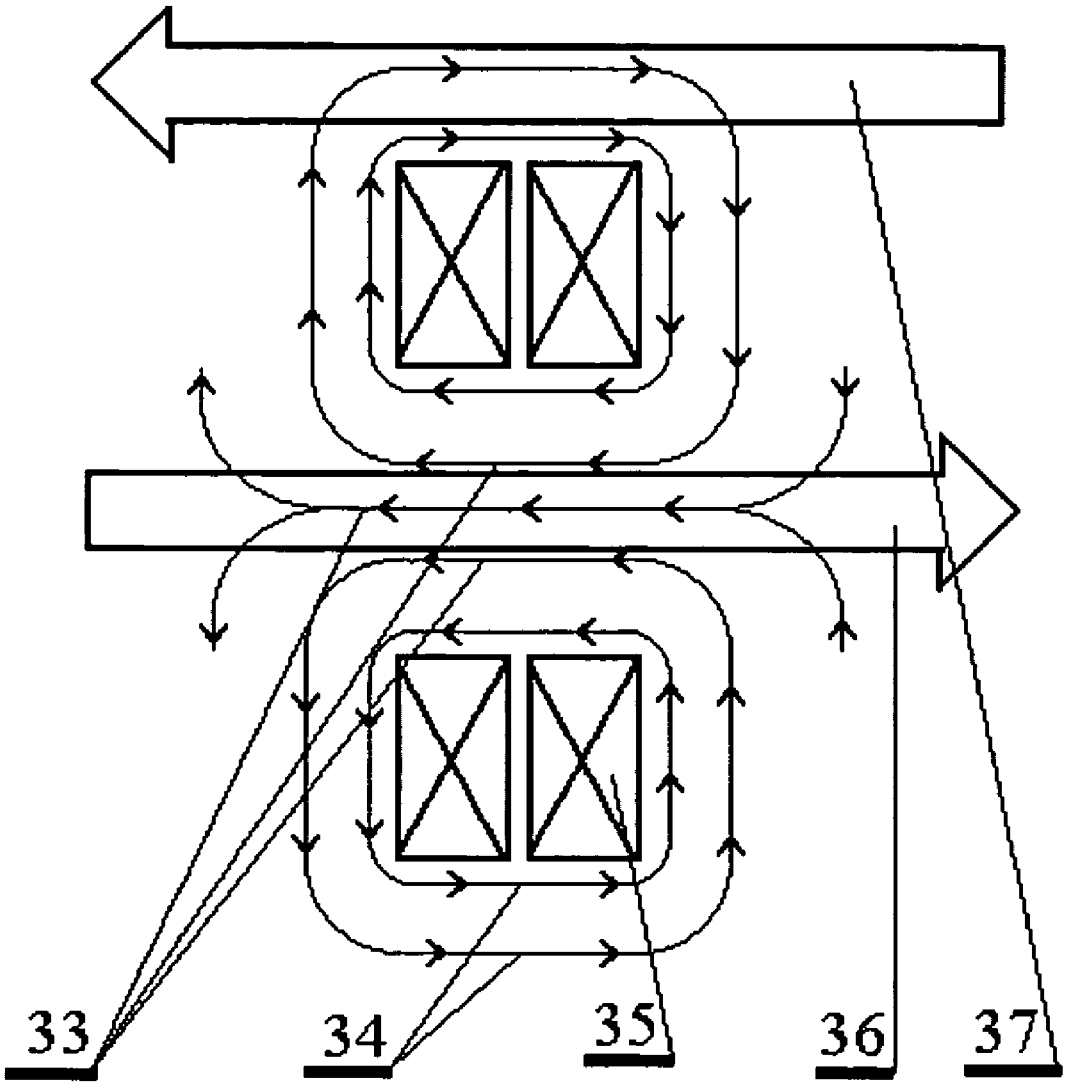
FIG. 12 illustrates the scheme of the formation of the strength lines of the vortex electric field, which is generated by the magnetic inductors in the acceleration section without conductive screen.

The scheme of the formation of strength lines of the vortex electric field, which are generated by the magnetic inductor without the conductive screen, is shown in FIG. 12. The strength lines of the field, which are responsible for the beam acceleration within the inner accelerative channels, are represented at 33. The strength lines of the field, which are responsible for the beam acceleration within the external accelerative channels, are shown generally at 34. The magnetic cores are illustrated at 35 and, the inner and external accelerated charged particle beams are shown at 36 and 37, respectively. The vortex electric field, pictured by strength lines 33 and 34, is generated by the changing magnetic fluxes in time, which circulate within cores 35. This occurs due to the effect of the electromagnetic induction. As is readily seen, the strength lines exhibit four characteristic parts: an external part, an inner part, and two lateral parts. Traditionally, only the inner part 33 is used for acceleration of the charged particles like 36. Using the external part of the electric field, which corresponds to strength lines 34, for acceleration of the beams like 37, is one of the primary features of the invention.

Figure 13:
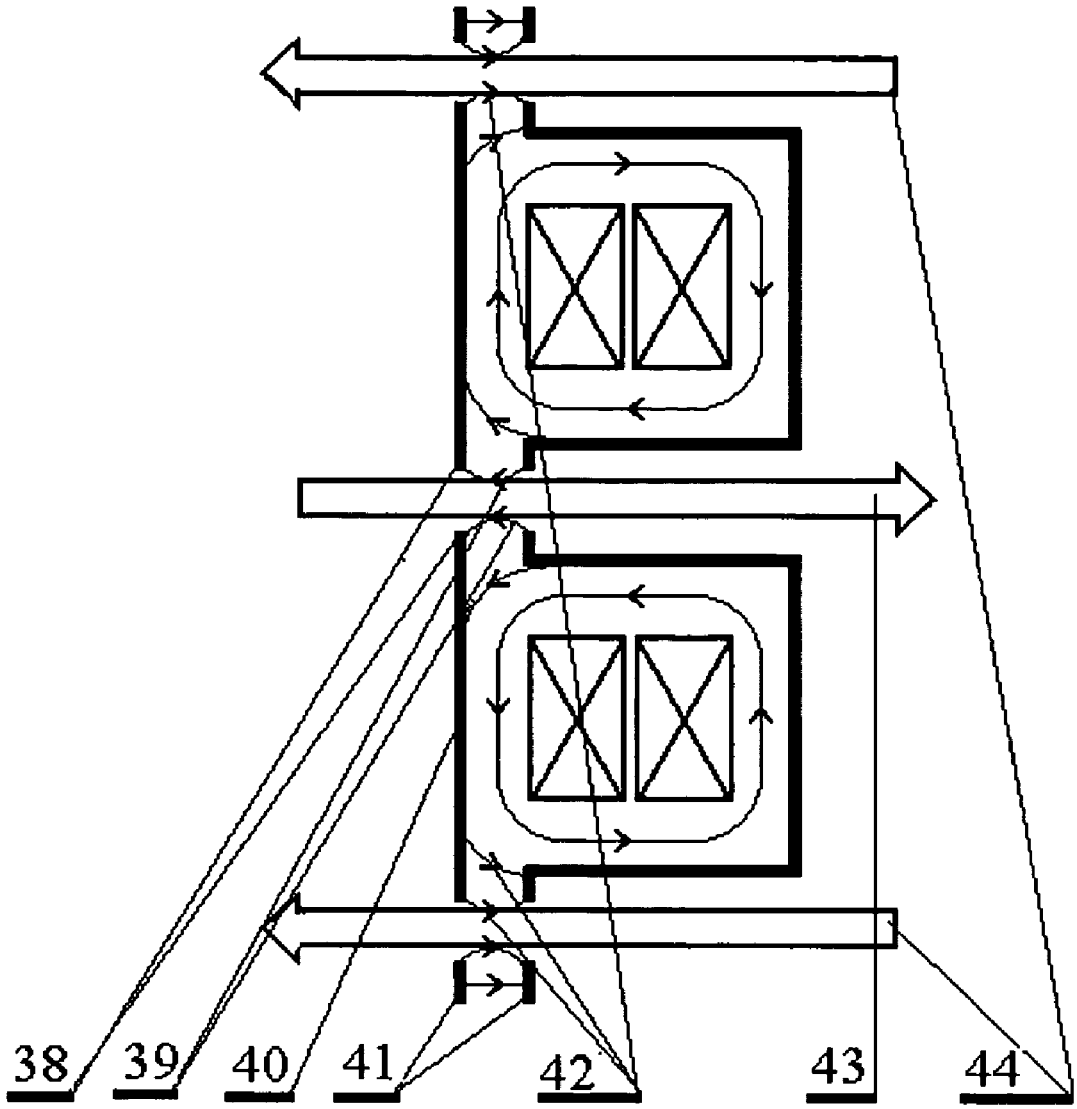
FIG. 13 illustrates a similar scheme as that shown in FIG. 12, but the slit being made in the external as well as the internal parts of the conductive screen.

The design realization of this idea is illustrated in FIG. 13. Here 38 is an inner slit, which is made in the inner part of the conductive screen. The strength lines within the inner accelerative space are represented generally at 39. 40 is the conductive screen, 41 is the external slits in screen 40. 42 are the strength lines within the external accelerative spaces. 43 is the inner charged particle beam, while 44 are the external charged particle beams. Contrary to the preceding case (see FIG. 12), the vortex electric field generated by the magnetic inductors 35 is spatially confined. This is achieved by introduction of the magnetic screen 40. As a result, the electric field is localized within the inner volume of the screen. The exceptions are the electric field in the inner 38 and external 41 slits in the screen 40 (compare with FIG. 12). The strength lines 39 and 42 illustrate these parts of the field. Charged particle beams 43 and 44 are directed in the accelerative spaces with these fields. As is readily seen, they move in the reciprocally opposite directions. The external beams 44 are accelerated under the action of the external part of the field 42, and the inner beam 43 is accelerated by the field 39.

The use of only electric field 39 for acceleration of the inner beam 43 is conventional. In the case of the present invention, however, the external beams 44, additionally can be accelerated. The result is that more than one charged particle beam can be accelerated simultaneously using the same magnetic inductors 35 (see FIG. 12). This leads to an essential increase in the device efficiency $\eta_E$. This effect can be illustrated in the simplest case of a MUNIACE consisting of one linear induction block only, and comprising a few inner and external channels (see, for example, the design version shown in FIGS. 8 and 9). The mentioned effect can be described mathematically in the considered case using the following formula (see also formula (1) for comparison:

$$\eta_E \cong \frac{a(n+\alpha m)P_{us}}{a(n+\alpha m)P_{us}+P_{los}}, \tag{2}$$

where a is the number of beams, n is the number of inner channels, m is the number of external channels in the same linear induction block, $\alpha$ is a factor that takes into account that the accelerative voltage is lower in the external channels than in the inner ones. This factor depends essentially on the form of the conductive screen. Other designations are given previously in connection with formula (1). It is readily seen that the efficiency can be increased for $$\frac{\eta_E}{\eta_p} \cong \frac{a(n+\alpha m)(1+P_{us}/P_{los})}{a(n+\alpha m)P_{us}/P_{los}+1}, \tag{3}$$

times by using the design scheme with external channels and many inner channels. Here the efficiency of prototype $\eta_p$ is determined by formula (1). It is not difficult to obtain relevant numerical estimations for the partial case of design, which is shown, for example, in FIG. 9: a=2, n=4, $\alpha$=0.4 m=2, $P_{us}/P_{los}$=1 (that means $\eta_p$=0.5) that the efficiency increases from $\eta_p$=0.5 (the prior system) to $\eta_E$~0.9 (the invented design), i.e., the increasing of efficiency $\eta_E/\eta_p$ in this case is 1.8 times.

The important property of the MIACE is that the accelerating electric field in the inner and external accelerative spaces are directed reciprocally opposite (see the illustration shown in FIG. 13). This means that the simultaneously accelerated external and internal beams with the same charge should be directed also in the reciprocally opposite directions. The simultaneous acceleration in the same direction is possible, as is mentioned already with respect to FIG. 4, in the case only, when both types of beams consist of opposite charges (electrons and positive ions or positive and negative ions). As is mentioned above, the acceleration of beams with the same charge in the MLINIACE and in the same direction is possible only in the trigger mode.

Figure 14:
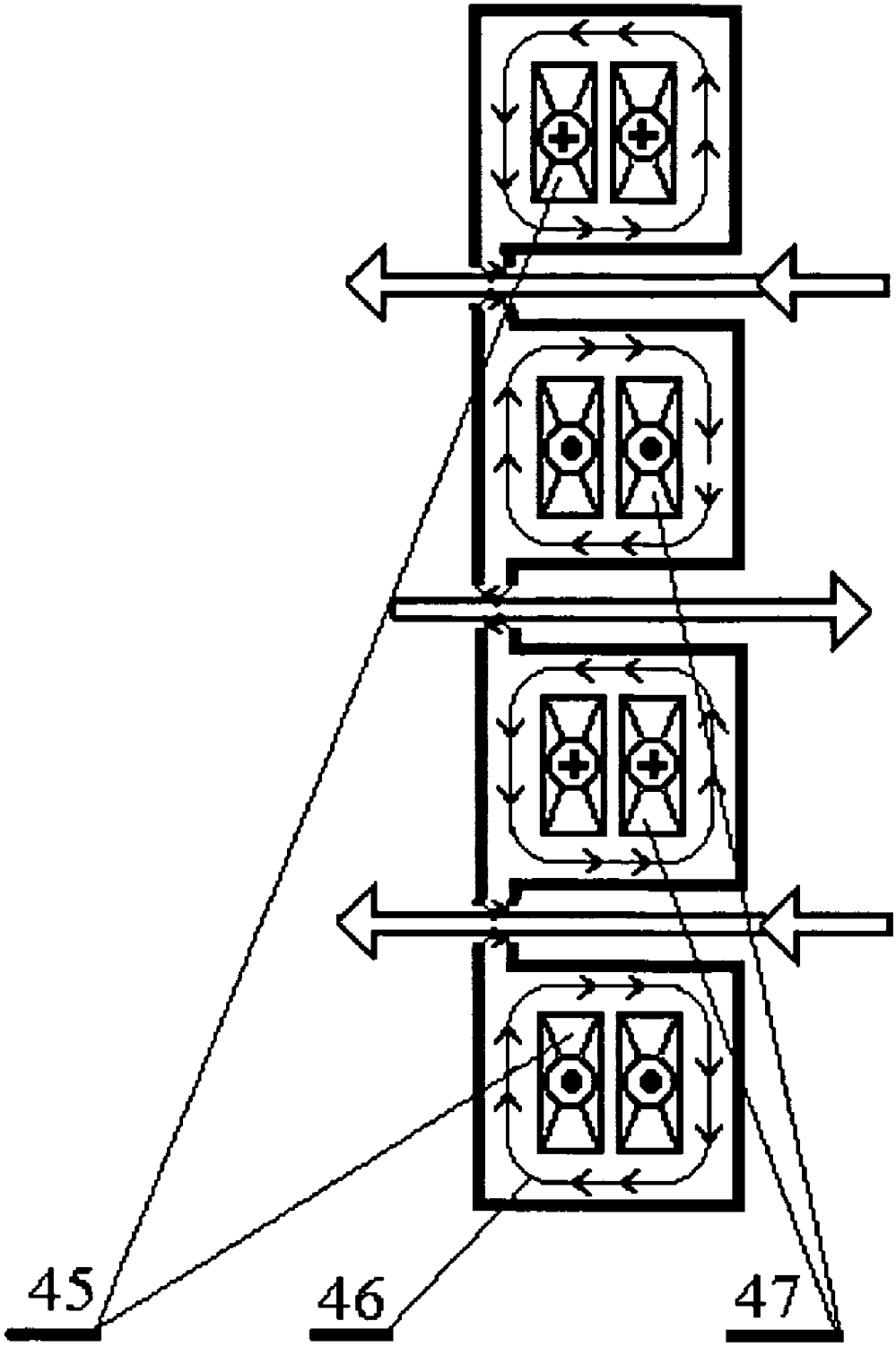
FIG. 14 illustrates a similar scheme as that shown in FIG. 13, but the external inductors with conductive screen and inner slit are introduced coaxially.
Figure 15:
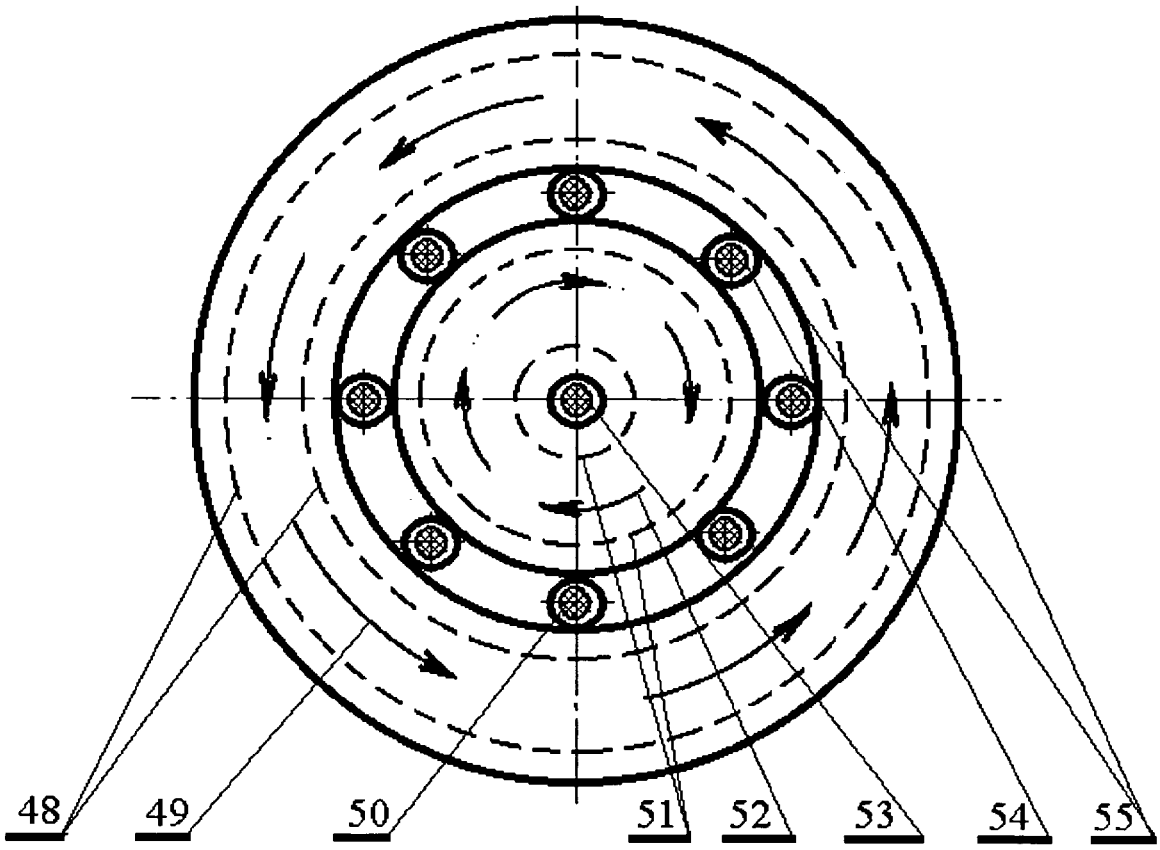
FIG. 15 is a cross-sectional view of the injector shown in FIG. 13.
Figure 16:
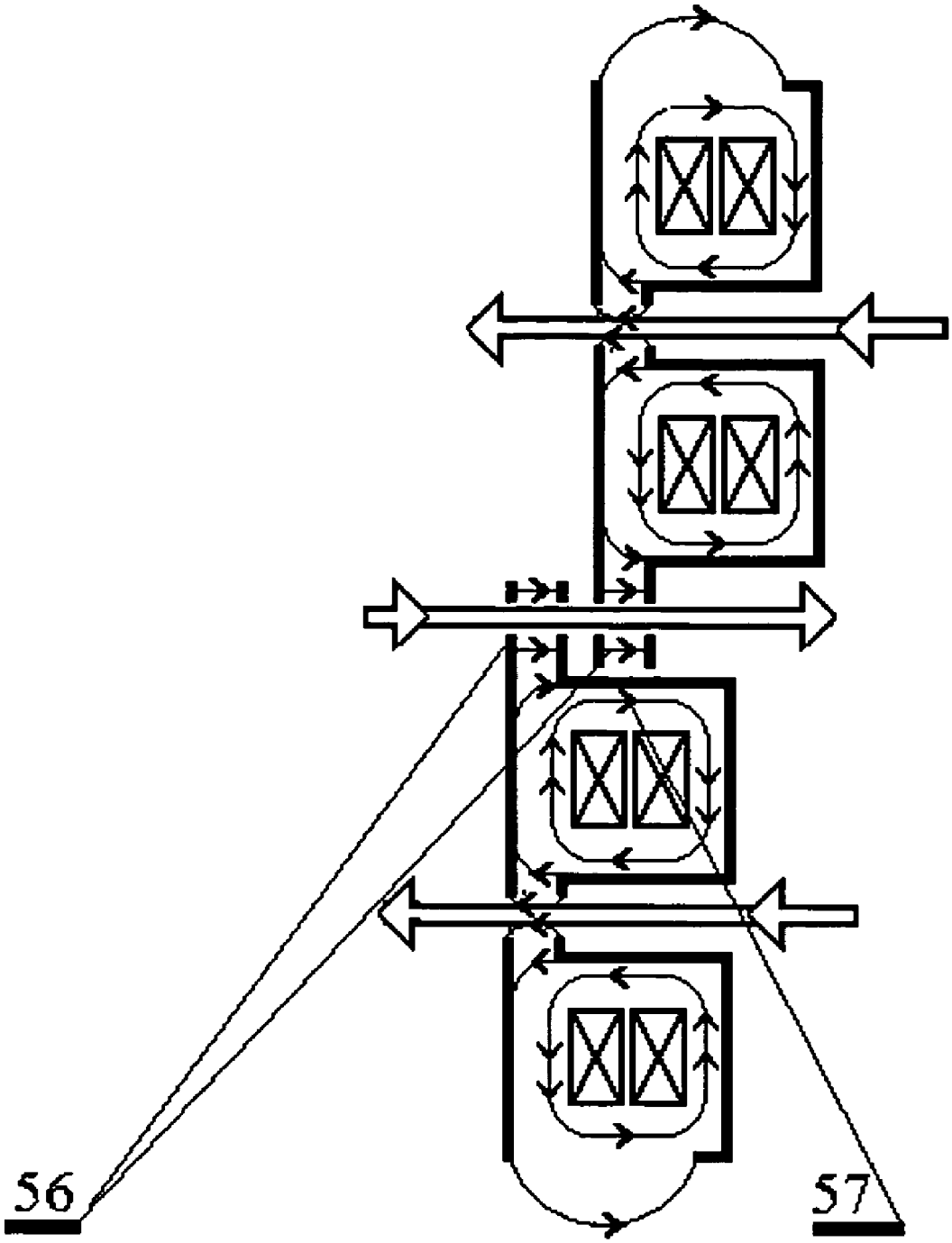
FIG. 16 illustrates the operation principle of accelerative blocks connected in series.

The physical aspects of the MIACE with external inductors (see FIGS. 8, 9 and 11) are explained in FIGS. 14 and 15. The accelerative section, like that shown in FIGS. 13, 14 is encompassed by the external inductor 45 (the dots and crosses in circles designate a directions of circulation of the magnetic fluxes in the magnetic cores). The changing on time of the magnetic flux within the cores of the external inductor 45 leads to generation of the vortex electric field. Strength lines 46 represent this field. As is readily seen, the strength lines of this field are circulated in the opposite direction compared to the strength lines of the electric field generated by the inner inductors 47. This means that directions of both types of the strength lines within the accelerative spaces turn out to be the same (see FIG. 14). Owing to this, the acceleration voltage in the external channels increases. The value of this increasing depends on the design scheme of connection of electrodes of the external inductor with the external channels, i.e., is this scheme the parallel one, like that is shown in FIG. 14, or connection in series. In both cases, the accelerative rate of the external channels increases.

The above-discussed physical picture is illustrated more evidently in FIG. 15. Here, the profile projection of the system shown in FIG. 14 is represented. The dotted lines 45 correspond to external inductors 45. The direction of circulation of the external magnetic flux is shown at 49. The external accelerated beams 44 (see also FIG. 13) are shown at 50. The inner magnetic inductors 47 are shown at 51, and direction of circulation of the inner magnetic flux is presented at 52. 53 is the inner accelerated beam 43 (see FIG. 13) and 54 is other external accelerated beams. The conductive screen is shown at 55.

Another advantage of the MIACE is a possible increase in the accelerative rate in the external channels using neighboring induction acceleration blocks, which accelerative spaces 56 are connected in series (see, for example, the design version shown in FIG. 6). The physical aspects of this design solution are explained in FIG. 16. As is seen, the directions of circulation of electric strength lines 57 around inductors in both neighboring accelerative sections are mutually opposite. Comparing the drawing in FIGS. 13 and 16, respectively, it is not difficult to conclude that the acted voltage per unit of channel length is at least two times higher than in the case of a separate external channel. This effect can be explained in the following manner. Each accelerative section like that shown in FIG. 13 can be treated (with respect to the accelerated beams) as a source of the accelerative voltage. Connecting two such sources in series (that is made in the design-scheme illustrated, for instance, in FIG. 6), in accordance with the well known principles of electrical engineering, allows to increase the voltage acting on the beam for two times. Connection of three such sections increases the voltage three times, and so on.

Figure 17:
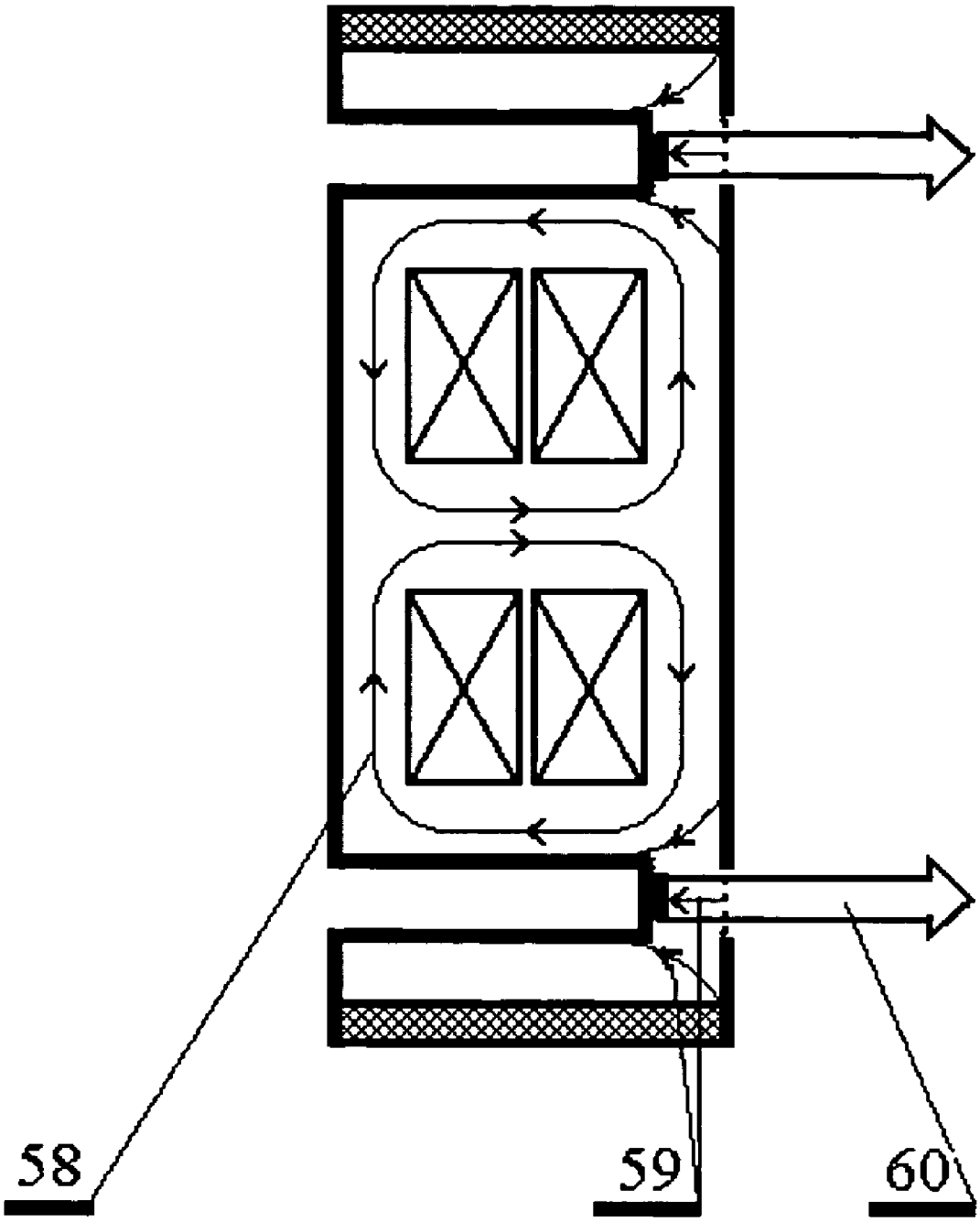
FIG. 17 illustrates the operation principle of the multi-beam injector with external cathodes and anodes.

The operation principles of the induction injectors with external placing cathodes and anodes are illustrated in FIG. 17. Here 58 are the strength lines within volume of the conductive screen. The electric field, corresponding to these lines, is generated by the magnetic field in the inductor cores. Item 59 illustrates part of the strength lines of the electric field, which causes the emission of changed particles from cathodes. As is readily seen, the design discussed, from the physical point of view, is close to the acceleration section with the external channels discussed above (see, for instance, FIG. 13). The only difference is that the cathodes in the considered case are placed within the accelerative spaces. The row of anodes are positioned on the opposite side of the accelerative space. The partial charged particle beams 60 are generated as a result of acceleration of the emitted charged particles within the acceleration space of the charged particles.

Figure 18:
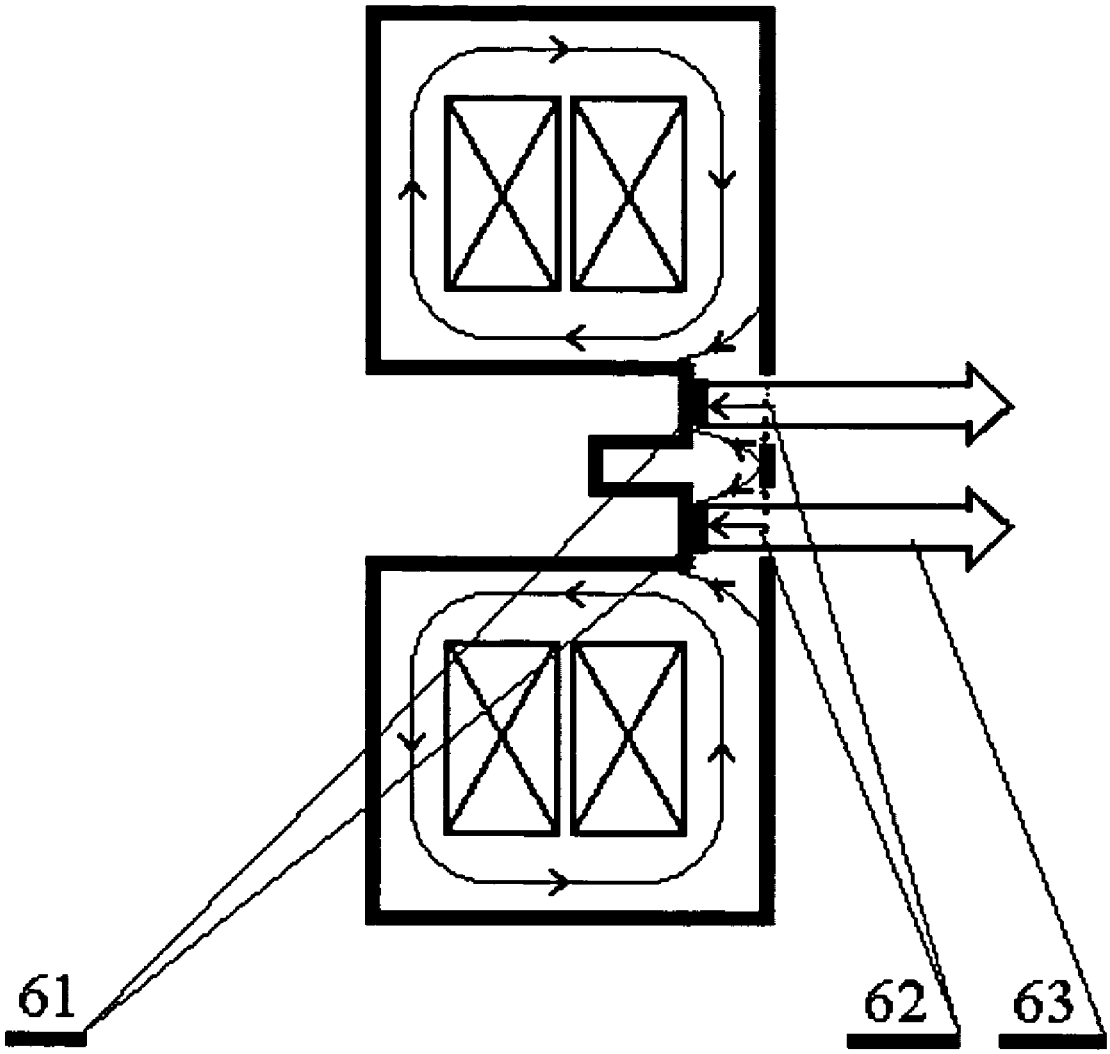
FIG. 18 illustrates the operation principle of the multi-beam injector with inner cathodes and anodes.

Analogously, the design of the accelerative section with inner accelerative space is put in the basis of the multi-channel injector shown in FIG. 18. Here 61 are the cathodes, which are placed within the accelerative space. The anodes are placed on the opposite side of the accelerative space. Contrary to prior art injectors, comprised by only one cathode and one anode, the number of cathodes here is more than one. This allows several inner charged particle beams 63 to be injected simultaneously.

Figure 19:
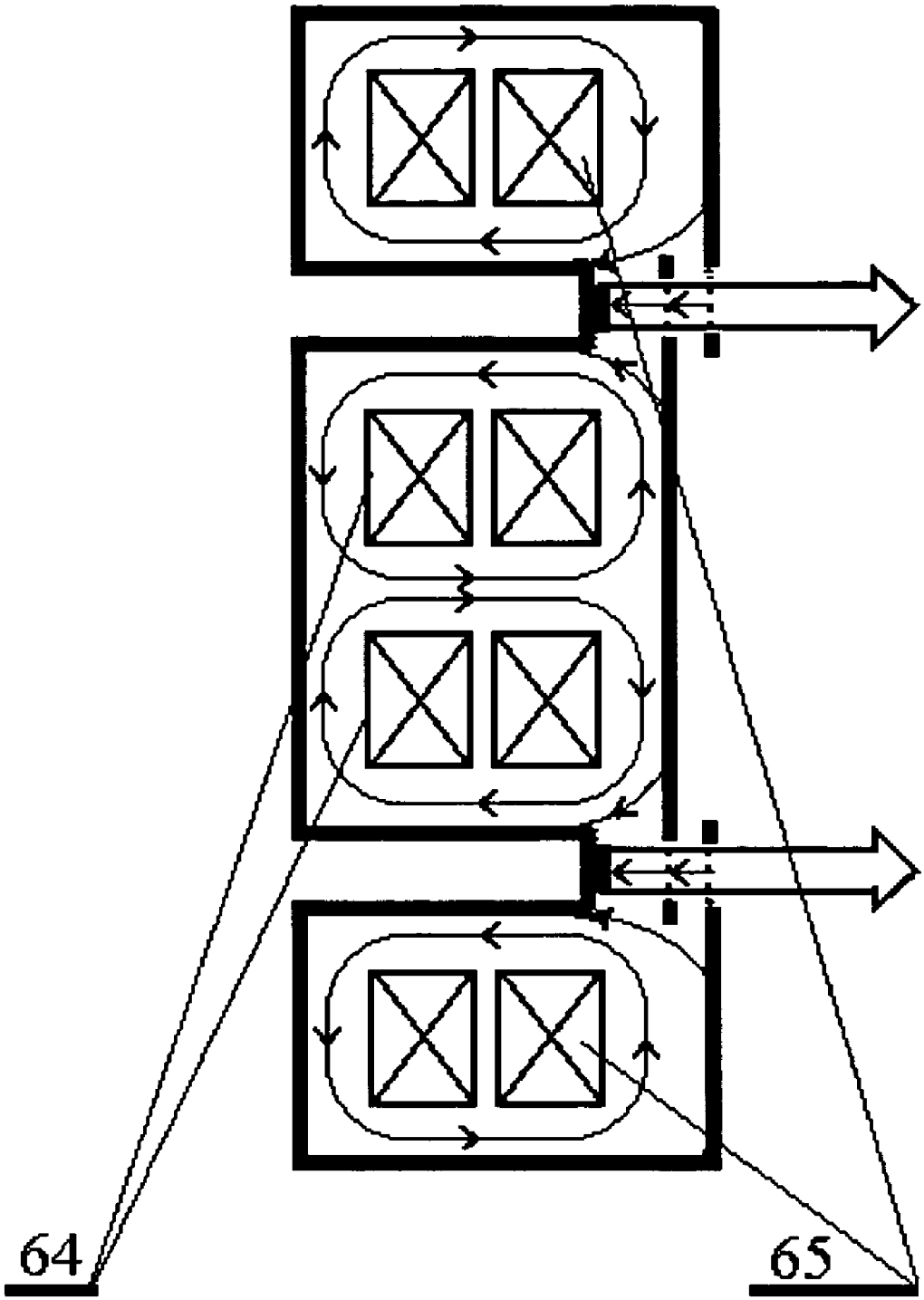
FIG. 19 illustrates the operation principle of the multi-beam injector with external cathodes and anodes and with external inductors.

Finally, the operation principles of the injectors with external cathodes and external magnetic inductors are illustrated in FIG. 19. Here 64 are the inner magnetic inductors and 65 are the external magnetic inductors. The design discussed can be represented conditionally as the multi-channel injector shown in FIG. 17, which is encompassed by the external inductors 64. This allows to increase the accelerative voltage between the cathodes and anodes and, hence, to increase additionally the total beam current. Therein, two variants of this encompassing are proposed. The parallel and in series design schemes are proposed for such an arrangement. In the first case the voltage increasing is not essential. But, the homogeneity of the electric field in the accelerating spaces is much better. In the second case (see FIG. 19), the intensity of the electric field increases at two times.

The invention allows using the accelerator as a commercial-type compact accelerator of charged particles, including single and many relativistic charged particle beams.

While the invention has been described with reference to a preferred embodiment, those skilled in the art will understand that various changed may be made and equivalents may be substituted for elements therefore without departing from the scope of the invention. In addition, many modifications may be made to adapt a particular situation or material to the teachings of the invention without departing from the essential scope thereof. Therefore, it is intended that invention not be limited to particular embodiment disclosed as the best mode contemplated for carrying out this invention, but that the invention will include all embodiments falling within the scope of the appended claims. In this application all units are the metric system and all amounts and percentages are by weight, unless otherwise expressly indicated. Also, all citations referred herein are expressly incorporated herein by reference.

The invention claimed is:

1. A multi-channel induction accelerator with external channels, comprising:

an injector block;

a drive system;

a block of output systems; and a multi-channel induction accelerative block comprising an aggregate of linear induction accelerative blocks, each accelerative block comprising a sequence of linearly connected accelerative sections, each accelerative section comprising one or more magnetic inductors enveloped by a conductive screening having an inner part and an external part, wherein one or more inner accelerative channels are placed axially within the inner part of the conductive screening and which have one or more azimuthally oriented slits, and wherein one or more inner channel electrodes are connected electrically with different parts of the inner part of the conductive screening that are separated by the one or more slits.

2. The multi-channel induction accelerator with external channels of claim 1, further comprising at least one external accelerative channel oriented axially along the external part of the conducting screen and having one or more external channel electrodes, at least one of the azimuthally-oriented slits being made in the external part of the conducting screen and the external channel electrodes of the external accelerative channel being connected electrically with different parts of the external part of the screen separated by the slit.

3. The multi-channel induction accelerator with external channels of claim 2, wherein at least one block of the output systems is formed as a block of solenoidal turning systems, wherein at least one of these solenoidal turning systems connects the one or more inner accelerative channels with the one or more external accelerative channels.

4. The multi-channel induction accelerator with external channels of claim 2, wherein the block of output systems is made as an aggregate of outlet devices for the partial beams which are accelerated within the one or more inner accelerative channels and the one or more external accelerative channels.

5. The multi-channel induction accelerator with external channels of claim 2, further comprising a first linear induction accelerative block having a plurality of pairs of first linear induction accelerative block electrodes connected thereto and a second linear induction accelerative block having a plurality of pairs of second linear induction accelerative block connected thereto, the first and second linear induction accelerative blocks being parallel and electrically connected with the same external accelerative channel such that each pair of said first linear induction accelerative block electrodes, excluding the outmost pairs of the first linear induction accelerative block electrodes, are placed between two pairs of analogous second linear induction accelerative block electrodes, and each said second linear induction accelerative block electrodes, excluding the outmost pairs of the second linear induction accelerative block electrodes, are placed between two pairs of analogous first linear induction accelerative block electrodes.

6. The multi-channel induction accelerator with external channels of claim 4, wherein the injector block comprises devices for generation of beams of charged particles with opposite electrical signs.

7. The multi-channel induction accelerator with external channels of claim 4, wherein the injector block comprises devices for generation of beams of charged particles with the same electrical sign and which are capable of operating in a trigger mode.

8. The multi-channel induction accelerator with external channels of claim 2, wherein the injector block comprises at least one induction multi-beam charged particle injector having cathodes and anodes placed within the one or more azimuthal slits in the external part of the conductive screening.

9. The multi-channel induction accelerator with external channels of claim 2, wherein one of the slits of the inner part of the conductive screen defines an accelerative space and the injector block comprises at least one induction multi-beam charged particle injector having at least two cathodes and two anodes placed within the accelerative space.

10. The multi-channel induction accelerator with external channels of claim 3, further comprising at least two linear induction accelerative blocks, each linear induction accelerative block comprising at least two inner accelerative channels and wherein the solenoidal turning systems connect the inner accelerative channels of different linear induction accelerative blocks.

11. The multi-channel induction accelerator with external channels of claim 2, further comprising one or more multi-channel induction accelerative blocks placed in the coaxial manner within at least one of the magnetic inductors, which is enveloped by a magnetic inductor conducting screen, and wherein the one or more azimuthally-oriented slits are made in the inner part of the magnetic inductor conducting screen and the one or more inner channel electrodes which are connected electrically with different parts of the magnetic inductor conducting screen are connected with the external channel electrodes.

12. The multi-channel induction accelerator with external channels of claim 9, wherein the induction multi-beam charged particle injector is placed in the coaxial manner within at least one of the magnetic inductors, which is enveloped by a magnetic inductor conducting screen, and wherein the one or more azimuthally-oriented slits are made in the inner parts of the magnetic inductor conducting screen and the inner channel electrodes, which are connected electrically with different parts of the magnetic inductor conducting screen, are connected with the external channel electrodes of the induction multi-beam charged particle injector.

* * * * *